US012781406B2

(12) United States Patent
Song et al.

(10) Patent No.: US 12,781,406 B2
(45) Date of Patent: Nov. 3, 2026

(54) ECO-FRIENDLY FLAME RETARDANT FABRIC AND PREPARATION METHOD THEREOF

(71) Applicant: INDUSTRY-ACADEMIC COOPERATION FOUNDATION CHANGWON NATIONAL UNIVERSITY, Gyeongsangnam-do (KR)

(72) Inventors: Jung-Il Song, Changwon-si (KR); Maksym Li, Changwon-si (KR); Prabhakar Muchukota Narendra, Changwon-si (KR); Dong-Woo Lee, Changwon-si (KR)

(73) Assignee: INDUSTRY-ACADEMIC COOPERATION FOUNDATION CHANGWON NATIONAL UNIVERSITY, Gyeongsangnam-do (KR)

( * ) Notice: Subject to any disclaimer, the term of this patent is extended or adjusted under 35 U.S.C. 154(b) by 344 days.

(21) Appl. No.: 18/227,502

(22) Filed: Jul. 28, 2023

(65) Prior Publication Data

US 2024/0044063 A1 Feb. 8, 2024

(30) Foreign Application Priority Data

Aug. 2, 2022 (KR) ..... 10-2022-0096400

(51) Int. Cl.
*D06B 21/00* (2006.01)
*D06B 3/10* (2006.01)
(Continued)

(52) U.S. Cl.
CPC ..... *D06B 21/00* (2013.01); *D06B 3/10* (2013.01); *D06M 13/144* (2013.01); *D06M 13/188* (2013.01); *D06M 13/292* (2013.01); *D06M 13/432* (2013.01); *D06M 13/507* (2013.01); *D06M 15/03* (2013.01); *D06M 23/10* (2013.01); *D06M 2101/06* (2013.01); *D06M 2200/30* (2013.01)

(58) Field of Classification Search
CPC ..... D06B 21/00; D06B 3/10; D06M 13/144; D06M 13/188; D06M 13/292; D06M 13/432; D06M 13/507; D06M 15/03; D06M 23/10; D06M 2101/06; D06M 2200/30
See application file for complete search history.

(56) References Cited

FOREIGN PATENT DOCUMENTS

CN 106948172 A 7/2017
CN 108729330 A 11/2018

OTHER PUBLICATIONS

Magovac, Materials 2020, 13, 5492; doi: 10.3390/ma13235492.*
(Continued)

*Primary Examiner* — James M Mellott
(74) *Attorney, Agent, or Firm* — Osha Bergman Watanabe & Burton LLP

(57) ABSTRACT

The present disclosure relates to an eco-friendly flame retardant fabric and a preparation method thereof and in particular to an eco-friendly flame retardant fabric and a preparation method thereof prepared by sequential surface treatment with two types of solutions. According to the present disclosure, flame retardancy and durability may be improved by surface-treating a flammable natural fiber using an eco-friendly flame retardant.

9 Claims, 7 Drawing Sheets

(51) Int. Cl.

| | |
|---|---|
| ***D06M 13/144*** | (2006.01) |
| ***D06M 13/188*** | (2006.01) |
| ***D06M 13/292*** | (2006.01) |
| ***D06M 13/432*** | (2006.01) |
| ***D06M 13/507*** | (2006.01) |
| ***D06M 15/03*** | (2006.01) |
| ***D06M 23/10*** | (2006.01) |
| ***D06M 101/06*** | (2006.01) |

(56) References Cited

OTHER PUBLICATIONS

Barbalini, Polymers 2019, 11, 1664; doi: 10.3390/polym11101664.*
Roy, Biological Activities and Application of Marine Polysaccharides, Chapter 12: Chitosan-Based Sustainable Textile Technology: Process, Mechanism, Innovation, and Safety, Intechopen, 2017; DOI: 10.5772/65259.*
IPTEK, The Journal for Technology and Science, vol. 24, No. 2, Aug. 2013.*
Office Action issued in counterpart Korean application No. 10-2022-0096400, dated May 23, 2024 (14 pages).
Fu, J., Yang, F., Chen, G., Zhang, G., Huang, C., & Guo, Z. (2019). A facile coating with water-repellent and flame-retardant properties on cotton fabric. New Journal of Chemistry, 43(25), 10183-10189. https://doi.org/10.1039/c9nj02240f.

* cited by examiner 0 s 6 s 12 s 18 s 24 s 30 s (a)

0 s 6 s 12 s 18 s 24 s 30 s (b)

(a)

(b)

(a)

(b)

ECO-FRIENDLY FLAME RETARDANT FABRIC AND PREPARATION METHOD THEREOF

CROSS-REFERENCE TO RELATED APPLICATIONS

This application claims the benefit under 35 U.S.C. 119(a) of Korean Patent Application No. 10-2022-0096400 filed on Aug. 2, 2022 with the Korean Intellectual Property Office, the entire disclosure of which is incorporated herein by reference for all purposes.

BACKGROUND

1. Field

The present disclosure relates to an eco-friendly flame retardant fabric and a preparation method thereof and in particular to an eco-friendly flame retardant fabric and its preparation method by sequentially surface-treating a natural fiber with two types of solutions.

2. Description of Related Art

Natural fibers refer to fibers that exist in their natural state and can be used as fibers through relatively simple physical manipulation. They can be broadly categorized into plant fibers such as cotton, flax, etc., animal fibers such as wool, silk, etc., and mineral fibers such as asbestos, etc.

Natural fibers are actively used in the research and development of composite materials due to their properties of eco-friendliness, light weight, biodegradability, low cost, high strength, good thermal-acoustic insulation. However, natural fibers have limited applications due to their flammability. In such a situation, when these natural fibers are made flame retardant using eco-friendly flame retardants, it allows for maintaining eco-friendliness and at the same time their utilization as reinforcing materials for the production of flame-retardant composite materials.

Recently, there has been an increasing demand for composite fibers that are both mechanically and chemically robust while also being environmentally friendly in terms of flame retardancy.

Therefore, the inventors of the present invention have completed the present invention by confirming that natural fibers can be sequentially surface-treated with two types of solutions (i.e., flame retardants) to improve flame retardancy and durability.

SUMMARY

The first objective of the present disclosure is to provide an eco-friendly flame retardant fabric with improved flame retardancy and durability and a preparation method thereof by surface treatment of flammable natural fiber using an eco-friendly flame retardant.

Furthermore, as its second objective, the present disclosure provides an eco-friendly flame retardant fabric and a preparation method thereof capable of improving the flame retardancy of natural fibers through a simplified process.

To achieve the purpose above, the present disclosure discloses a method of preparing an eco-friendly flame retardant fabric including dipping a natural fiber into a first solution comprising chitosan, carboxylic acid, and urea; drying the natural fiber dipped into the first solution; and dipping the dried natural fiber into a second solution including alcohol.

The natural fiber may be a lignocellulosic fiber containing cellulose.

The natural fiber may include at least one selected from a group of cotton fibers, hemp fibers, flax fibers, sisal fibers, abaca fibers, jute fibers, and coir fibers.

The carboxylic acid may include at least one selected from a group of acetic acid, formic acid, propionic acid, oxalic acid, malonic acid, succinic acid, palmitic acid, stearic acid, oleic acid, benzoic acid, salicylic acid, and linolenic acid.

The alcohol may include at least one selected from a group of methanol, ethanol, n-propanol, isopropanol, glycerin, n-butanol, isobutanol, Cert-butanol, n-pentanol, isopentanol, n-hexanol, isohexanol, n-heptanol, isoheptanol, n-octanol, isooctanol, n-nonanol, isononanol, n-decanol, isodecanol, 2-methoxyethanol, and 2-ethoxyethanol.

The second solution may further include tetraalkyl orthosilicate and an additive.

The tetraalkyl orthosilicate may include at least one selected from a group of tetraethyl orthosilicate (TEOS), tetramethyl orthosilicate (TMOS), tetrapropyl orthosilicate (TPOS), and tetrabutyl orthosilicate (TBOS).

The additive may include at least one selected from a group of phytic acid, ascorbic acid, kojic acid, inorganic acid, and lysophosphatidic acid.

The dipping into the first solution may be performed at 20 to 60° C. for 10 to 100 minutes.

The dry of the natural fiber dipped into the first solution may be performed at 20 to 40° C. for 1 to 20 hours.

The dipping into the second solution may be performed at 20 to 60° C. for 10 to 100 minutes.

The method may further include drying the natural fiber dipped into the second solution.

The drying of the natural fiber dipped into the second solution is performed at 20 to 40° C. for 1 to 20 hours.

An eco-friendly flame retardant fabric including a natural fiber; a first layer formed on the natural fiber and including chitosan, carboxylic acid, and urea; and a second layer formed on the first layer and comprising alcohol.

According to the present disclosure, surface treatment of a flammable natural fiber using an eco-friendly flame fabric enables improvement of flame retardancy and durability.

According to the present disclosure, the flame retardancy of a natural fiber can be improved by a simplified process, and an eco-friendly flame retardant fabric with excellent flame retardancy and improved surface durability can be obtained.

DETAILED DESCRIPTION

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

The term "flame retardant" refers to the property of materials that lies between flammable and non-flammable, indicating the characteristics of being difficult to ignite and burn. More specifically, flame retardancy refers to the property of preventing or inhibiting combustion by self-extinguishing or suppressing the ignition and combustion process once the material is in contact with flames. Flame retardancy is contrasted with non-flammability, where materials do not ignite or burn when exposed to flames, and flammability, where materials readily undergo combustion.

The term "dipping" refers to the operation of immersing a material in various liquids to adhere the liquid to its surface or to penetrate into its interior. It can be used interchangeably with terms such as immersion, submersion, application, addition, or incorporation.

The present disclosure provides a method of manufacturing an eco-friendly flame retardant fiber including: dipping a natural fiber into a first solution including chitosan, carboxylic acid, and urea; drying the natural fiber dipped into the first solution; and dipping the dried natural fiber into a second solution including alcohol.

Figure 1:
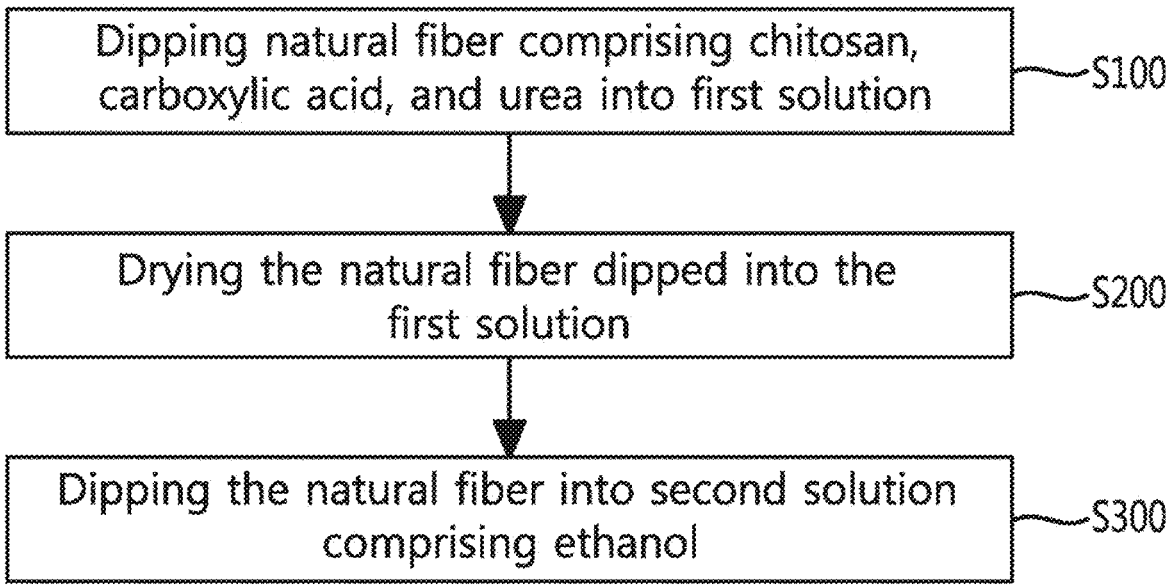
FIG. 1 illustrates a flow chart showing each step of a method of preparing an eco-friendly flame retardant fabric according to an embodiment of the present disclosure.

FIG. 1 illustrates a flow chart showing each step of a method of preparing an eco-friendly flame retardant fabric according to an embodiment of the present disclosure. Referring to FIG. 1, a method of preparing an eco-friendly flame retardant fabric according to an embodiment of the present disclosure includes dipping a natural fiber into a first solution containing chitosan, carboxylic acid, and urea; drying the natural fiber dipped into the first solution; and dipping the dried natural fiber into a second solution containing alcohol.

For the natural fiber used in the method of preparing an eco-friendly flame retardant fabric, lignocellulosic fiber may be used and, in particular, lignocellulosic fiber containing cellulose may be used. More specifically, Various types of lignocellulosic fibers, such as seed fibers (cotton, kapok cotton, etc.), bast fibers (flax, jute, hemp, etc.), xylem fibers (manila, sisal, New Zealand hemp, etc.), and fruit fibers (coyote, etc.), may all be utilized.

The natural fiber used in the present disclosure may include at least one selected from a group of cotton fibers, hemp fibers, flax fibers, sisal fibers, abaca fibers, jute fibers, and coir fibers. In particular, it is desirable for the natural fiber of the present disclosure to be cotton fiber, and if the surface of the fiber contains cellulose, various other plant-based natural fibers mentioned above may be used.

For the first solution of the present disclosure, the carboxylic acid may include at least one selected from a group of acetic acid, formic acid, propionic acid, oxalic acid, malonic acid, succinic acid, palmitic acid, stearic acid, oleic acid, benzoic acid, salicylic acid, and linolenic acid. In particular, regarding the first solution of the present disclosure, it is desirable for the carboxylic acid to be acetic acid, but it is not limited thereto.

Regarding the first solution of the present disclosure, it is desirable for the chitosan to be not only chitosan itself but also chitosan-based compounds for enhancing the flame retardancy and durability of natural fibers. In some cases, it may be replaced with chitin, pectin, collagen, gelatin, hyaluronic acid, heparin, alginate, and the like.

Regarding the first solution of the present disclosure, the urea may include a colorless arid odorless crystalline substance with the molecular structure of urea (CH4N2O), and it may be in the formforrr of either a single molecule or a compound.

Regarding the first solution of the present disclosure, the urea may include not only urea itself but also urea-based compounds. More specifically, in addition to urea in its single molecule form, the urea may include at least one selected from a group of thiourea, urea peroxide, polyoxymethylene urea, polyoxymethyiene cyanoguanidine urea, imidazolidinyl urea, hydroxyethyl urea, dimethyl urea, dimethylol urea, diazolidinyl urea, m-dimethylaminophenyl urea, dimethylol ethylene thiourea, and monoethanol urea.

Regarding the second solution of the present disclosure, the alcohol may include 1 to 6 valent alcohols with 1 to 50 carbon atoms e.g., aliphatic alcohol). In particular, the alcohol may preferably include 1 to 6 valent alcohols with 1 to 10 carbon atoms, but is is not limited thereto.

More specifically, regarding the second solution of the present disclosure, the alcohol may include at least one selected from a group of methanol, ethanol, n-propanol, isopropanol, glycerol, n-butanol, isobutanol, test-butanol, n-pentanol, isopentanol, n-hexanol, isohexanol, n-heptanol, isoheptanol, n-octanol, isooctanol, n-nonanol, isononanol, n-decanol, isodecanol, 2-methoxyethanol, and 2-ethoxyethanol. In particular, regarding the second solution of the present disclosure, for facilitating the dissolution of the included phosphoric acid, alcohol may be used, but it is not limited thereto.

Furthermore, the second solution in the method of preparing the eco-friendly flame retardant fabric of the present disclosure may further include silica precursor and additives. Here, the silica precursor may include tetraalkyl orthosilicate (TAOS).

In other words, in order to enhance the flame retardancy and durability of flammable natural fibers through surface treatment, the second solution may include ethanol, tetraalkyl orthosilicate, and additives, but it is not limited thereto.

Regarding the second solution of the present disclosure, the tetraalkyl orthosilicate may include at least one selected from a group of tetraethyl orthosilicate (TEAS), tetramethyl orthosilicate (TMOS), tetrapropyl orthosilicate (TPOS) and tetrabutyl orthosilicate (TBOS).

Furthermore, regarding the second solution of the present disclosure, the additives may include at least one selected from a group of phytic acid, ascorbic acid, kojic acid, inorganic acid, and lysophosphatidic add. In particular, regarding the second solution of the present disclosure, the additives may be phytic add, but it is not limited thereto. The phytic add is a natural plant antioxidant that is widely distributed in legumes, tree fruits, and cereal husks. The phytic acid is particularly soluble in water, acetone, and hydrous ethanol. Its chemical formula is C6H18024P6, and its molecular weight is 660.03.

In the method of preparing an eco-friendly flame retardant fabric according to the present disclosure, the first solution may be prepared by introducing chitosa carboxylic acid, and urea into a solvent, which is water, and stirring the mixture at a temperature of 20 to 40° C. for 1 to 300 minutes.

In the method of preparing an eco-friendly flame retardant fabric according to the present disclosure, the step of dipping into the first solution may be performed at a temperature of 20 to 60° C. for 10 to 100 minutes, and more preferably at a temperature of 30 to 50° C. for 20 to 50 minutes.

In the method of preparing an eco-friendly flame retardant fabric of the present disclosure, the step of drying of the natural fiber dipped into the first solution may be performed at a temperature of 20 to 40° C. for 1 to 20 hours, and in particular performed at a temperature of 25 to 30° C. for 4 to 12 hours. In particular, the step of drying the natural fiber dipped into the first solution may be performed at room temperature if there is an environment suitable for drying the natural fiber.

In the method of preparing an eco-friendly flame retardant fabric f the present disclosure, the second solution may contain alcohol, and additionally, the second solution may be prepared by adding tetraalkyl orthosilicate and additives to an alcohol solvent and stirring mixture for 1 to 150 minutes at a temperature of 20 to 40° C. Here, the alcohol may be ethanol, but it is not limited thereto. Here, the tetraalkyl orthosilicate may be tetraethyl orthosilicate (TEOS), but it is not limited thereto. Furthermore, the additive may be phytic acid, but it is not limited thereto.

In the manufacturing method of the present disclosure, step of dipping into the second solution may be performed at a temperature of 20 to 60° C. for 10 to 100 minutes, and in particular performed at a temperature of 30 to 50° C. for 20 to 50 minutes.

Furthermore, the method of preparing an eco-friendly flame retardant fabric of the present disclosure may further include the step of drying the natural fiber dipped into the second solution, but it is not limited thereto.

Furthermore, in the method of preparing an eco-friendly flame retardant fabric of the present disclosure, the step of drying the natural fiber dipped into the second solution may be performed at a temperature of 20 to 40° C. for 1 to 20 hours, and in particular at a temperature of 25 to 30° C. for 4 to 12 hours. In particular, the step of drying the natural fiber dipped into the second solution may be performed at room temperature if there is an environment suitable for drying the natural fiber.

The method of preparing an eco-friendly flame retardant fabric of the present disclosure may improve both the flame retardancy and the surface durability of a natural fiber treated with flame retardant by dipping a natural fiber into the first solution and drying the natural fiber, followed by dipping it into the second solution and drying the natural fiber. The natural fiber treated with flame retardant also may have waterproof effect. The waterproof effect prevents the flame retardant from being washed away by rain or moisture, thereby contributing to the fiber's long-lasting flame retardancy. The main materials that contribute to the waterproof effects are TEOS and hexamethyl disiloxane. Using only these two materials yields no effect, but excellent results are observed when performing surface treatment of natural fibers in the sequence of the first solution and the second solution.

Furthermore, the method of preparing an eco-friendly flame retardant fabric of the present disclosure may be performed by first dipping the natural fiber into the first solution drying the dipped natural fiber and then dipping the dried natural fiber into the second solution and drying the dipped natural fiber in order to improve the flame retardancy and durability of the natural fiber.

Meanwhile, the present disclosure further discloses an eco-friendly flame retardant fabric comprising a natural fiber; a first layer comprising chitosan, carboxylic acid, and urea; and a second layer formed on the first layer and comprising alcohol.

The duplicated matters regarding the method of preparing an eco-friendly flame retardant fabric of the present disclosure applies as stated above.

The eco-friendly flame retardant fabric of the present disclosure may be prepared according to the method of preparing the eco-friendly flame retardant fabric of the present disclosure.

In the eco-friendly flame retardant fabric of the present disclosure, the second layer may further contain tetraalkyl orthosilicate and additives. In other words, in order to improve the flame retardancy and durability in the surface treatment of a flammable natural fiber, the second layer may include alcohol, tetraalkyl orthosilicate, and additives, but it is not limited thereto.

The eco-friendly flame retardant fabric of the present disclosure is based on natural fibers, and a first layer may be coated or layered on a natural fiber in the form of a layer or film, and a second layer may be coated or layered on the first layer in the form of a layer or film. Here, the term "coating" or "layering" refers to a process in which the natural fibers are dipped into the first solution and the second solution and then dried.

In the eco-friendly flame retardant fabric of the present disclosure, the first layer may contain ingredients such as chitosan, carboxylic acid (i.e., acetic add), and urea in the first solution, and the second layer may contain ingredients such as alcohol ethanol), tetraalkyl orthosilicate (i.e., tetraethyl orthosilicate), and additives (i.e., phytic acid) in the second solution.

Furthermore, from the perspective of achieving high flame retardancy and durability of the natural fibers, in the eco-friendly flame retardant fabric of the present disclosure, a first layer may be formed first and then a second layer may be formed on the first layer.

Repetitive content is omitted in consideration of the complexity of the present specification. Terms not otherwise defined in the present specification have their customary meanings in the field of technology to which the present disclosure belongs.

Hereinafter, with reference to the accompanying drawings and embodiments will be described in more detail with respect to what the present specification claims. However, the drawings and embodiments presented in the specification may be modified in various ways by those skilled in the art and have various forms, and the description in the present specification is not limited to the specific disclosure form of the present disclosure. It should be regarded as including all equivalents or substitutes included in the spirit and technical scope of the present disclosure. In addition, the accompanying drawings are presented to help those skilled in the art to more accurately understand the present disclosure, and may be exaggerated or reduced than actual.

EMBODIMENT AND EVALUATION

1. Embodiment (1) Preparation of First Solution

A first solution was prepared by simultaneously adding 5% chitosan, 2% acetic acid, and 4% urea to distilled water, followed by stirring at 30° C. for 3 hours.

(2) Preparation of Second Solution

A second solution was prepared by simultaneously adding 2% tetraethyl orthosilicate (TEOS) and 5% phytic acid to ethanol, followed by stirring at 30° C. for 1 hour.

Figure 2:
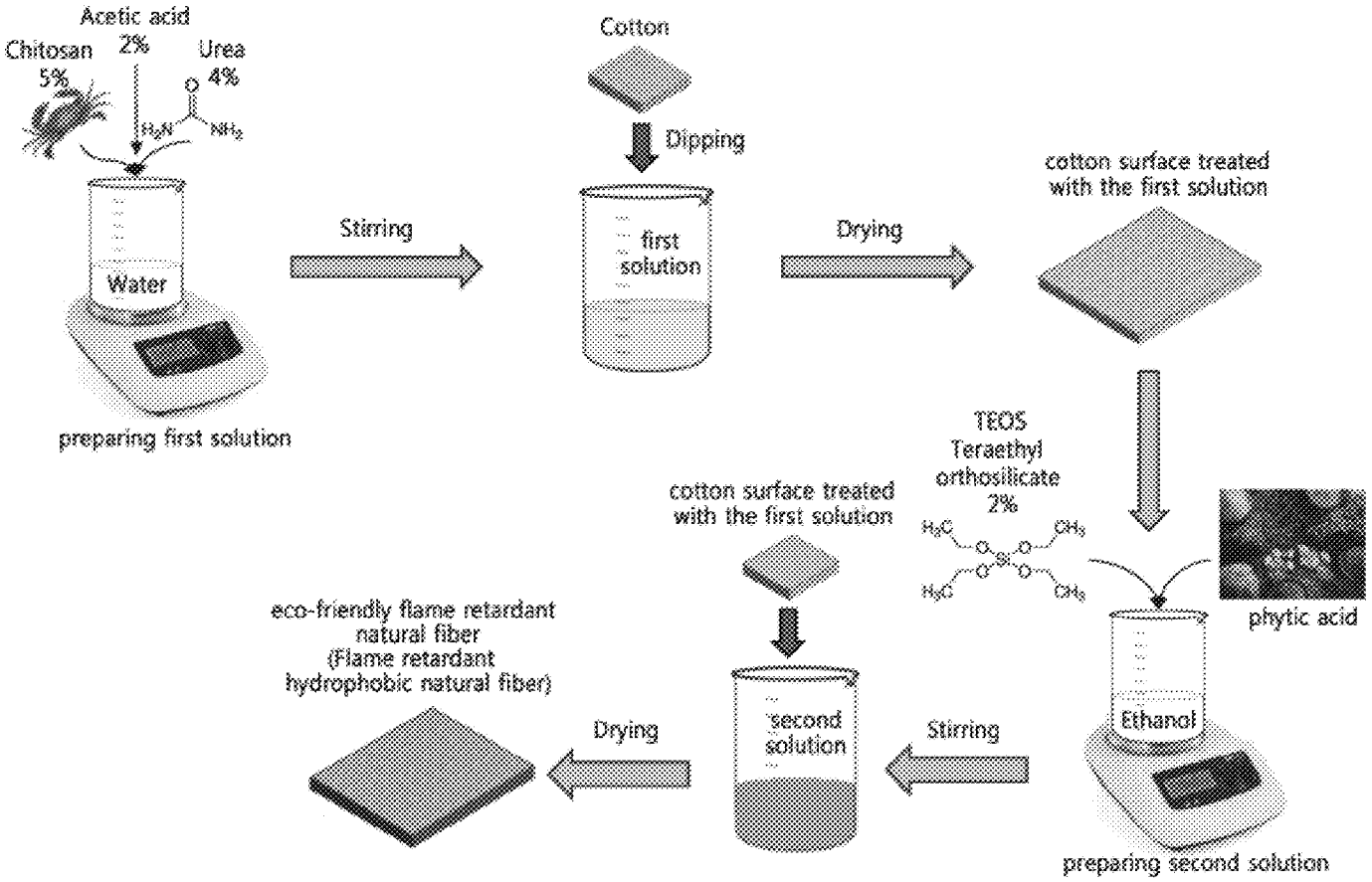
FIG. 2 illustrates a step-by-step diagram of a method of preparing an eco-friendly flame retardant fabric according to an embodiment of the present disclosure.

(3) Preparation of Eco-Friendly Flame Retardant Fabric of the Present Disclosure FIG. 2 illustrates a step-by-step diagram of a method of preparing an eco-friendly flame retardant fabric according to an embodiment of the present disclosure. Referring to FIG. 2, it can be confirmed that an eco-friendly flame retardant fabric according to an embodiment of the present disclosure was prepared by first dipping cotton into the first solution and drying it, and then dipping the dried cotton into the second solution and drying it.

The cotton was dipped into the first solution at room temperature for 30 minutes, then removed and sufficiently dried at room temperature for 8 hours. Afterward, the dried natural fiber was dipped into the second solution at room temperature for 30 minutes, then removed and sufficiently dried at room temperature for 8 hours. By sequentially treating the cotton with the first and second solutions, the surface treatment of the cotton was completed, resulting in the production of an eco-friendly flame retardant fabric according to an embodiment of the present disclosure (hereinafter referred to as "Embodiment 1").

(4) Preparation of Fabrics Surface-Treated with Only One Solution

Comparative Examples 1 and 2

A cotton according to one comparative example of the present disclosure (hereinafter referred to as "Comparative Example 1") was prepared by dipping cotton into the first solution at room temperature for 30 minutes, and then removing and sufficiently drying the cotton at room temperature for 8 hours.

On the other hand, a cotton according to another comparative example of the present disclosure (hereinafter referred to as "Comparative Example 2") was prepared by dipping another cotton into the second solution for 30 minutes, then removing and sufficiently drying the cotton at room temperature for 8 hours.

2. Measurement and Evaluation of Flame Retardancy Through Vertical Burning Test Vertical burning test was conducted according to the UL-94 standard test specification. The changes were measured every 6 seconds when flame was applied to the bottom of each fiber, and the results were captured through photography over a total duration of 30 seconds.

Figure 3:
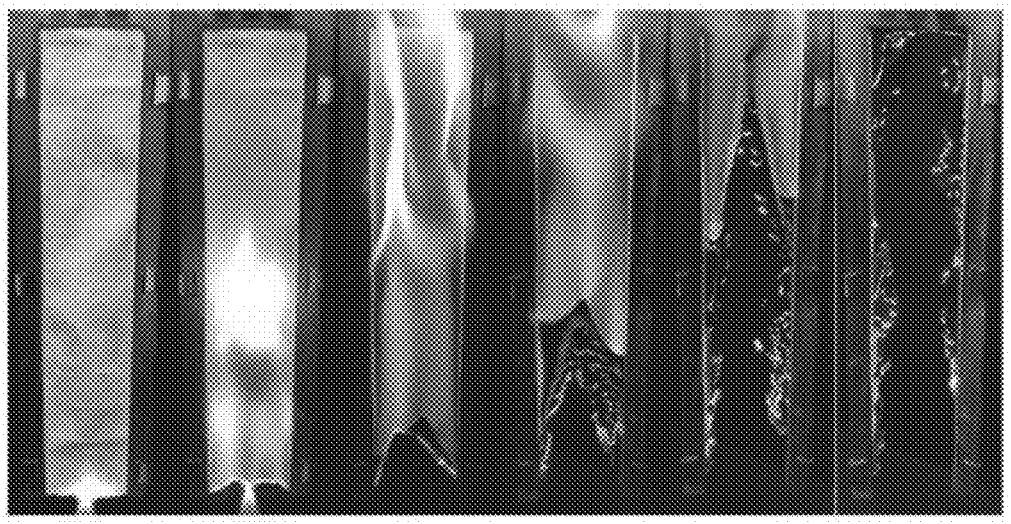
FIG. 3 illustrates a photograph showing the results of a vertical burning test of an eco-friendly flame retardant fabric prepared according to an embodiment of the present disclosure.
Figure 3:
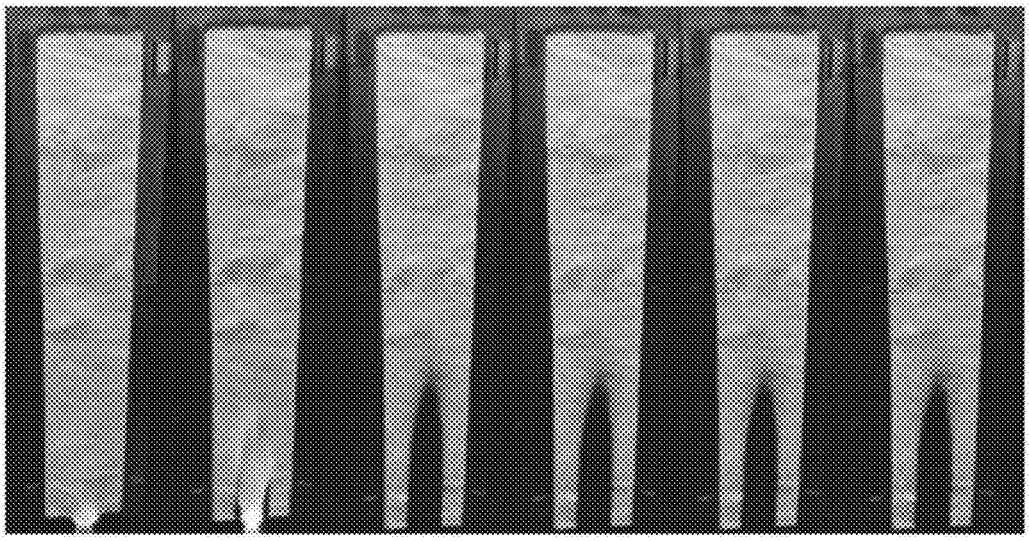

FIG. 3 illustrates a photograph showing the results of a vertical burning test of an eco-friendly flame retardant fabric prepared according to an embodiment of the present disclosure. Specifically, (a) of FIG. 3 shows the results of vertical burning test of flame-retardant untreated ordinary cotton, whereas (b) of FIG. 3 shows the results of vertical burning test of eco-friendly flame retardant fabric of Embodiment 1 of the present disclosure.

Referring to FIG. 3, it can be confirmed that, in the case of untreated cotton, the initially applied flame propagated the flame throughout the cotton and finally completely burned, whereas, in the case of eco-friendly flame retardant fabric of Embodiment 1 according to the present disclosure, when the flame was applied for 20 seconds, the flame was not propagated and exhibited excellent flame retardant properties that are self-extinguished.

3. Measurement and Evaluation of Durability Through Moisture Absorption Behavior Measurement The moisture absorption behavior was measured by dropping a few drops of colored water, apple juice, cola, coffee, milk, black tea, and the like added to each fiber to visually observe the degree of moisture absorption.

Figure 4:
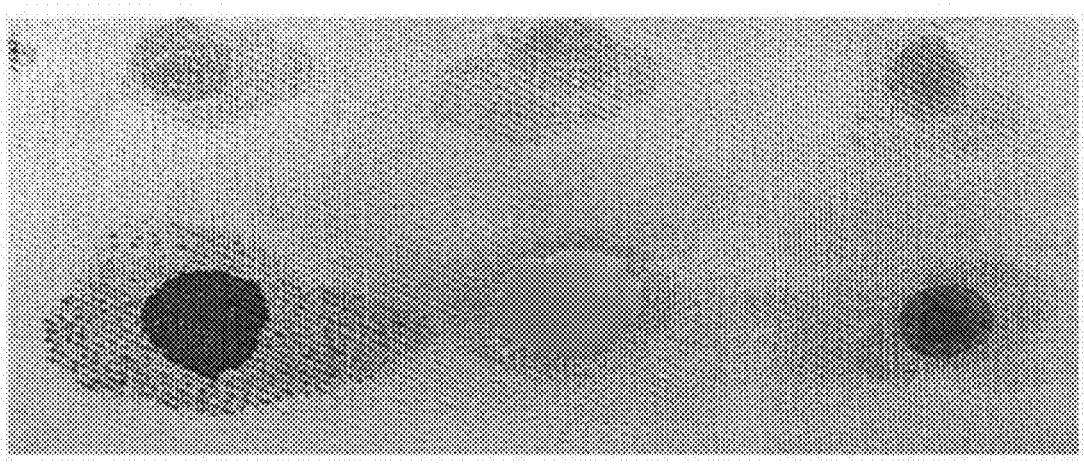
FIG. 4 illustrates a photograph showing the results of measuring the water absorption behavior of the eco-friendly flame retardant fabric prepared according to an embodiment of the present disclosure.
Figure 4:
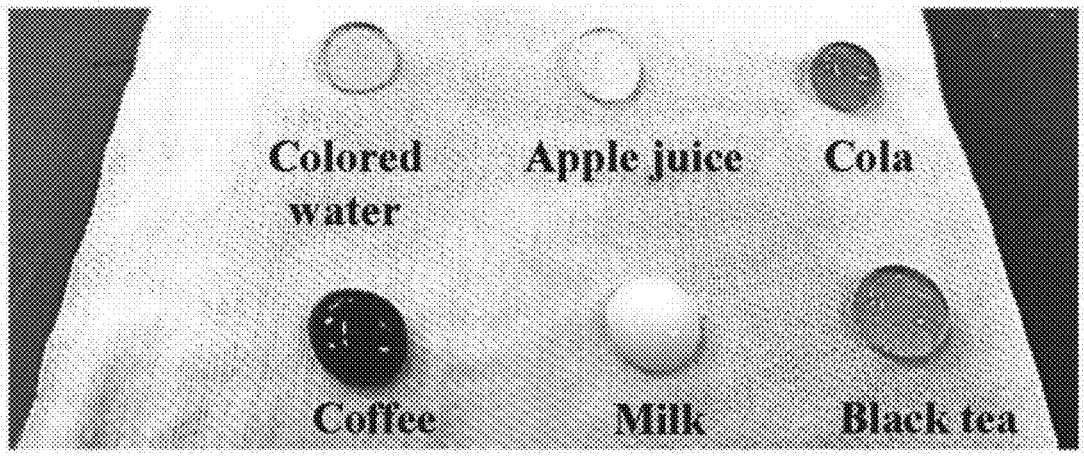

FIG. 4 illustrates a photograph showing a result of measuring moisture absorption behavior of an eco-friendly flame retardant fabric prepared according to an embodiment of the present disclosure. Specifically, (a) of FIG. 4 shows the results of measuring moisture absorption behavior of flame-retardant untreated ordinary cotton, whereas (b) of FIG. 4 shows the results of measuring moisture absorption behavior of an eco-friendly flame retardant fabric of Embodiment 1 of the present disclosure.

Referring to FIG. 4, it can be confirmed that: the flame-retardant untreated cotton absorbed moisture from colored water, apple juice, cola, coffee, milk, black tea, and the like, whereas the eco-friendly flame retardant fabric according to Embodiment 1 of the present disclosure did not absorb moisture from colored water, apple juice, cola, coffee, milk, and black tea. The untreated cotton easily can easily absorb water, or in other words, water can serve to wash the surface of cotton. On the other hand, the eco-friendly flame retardant fabric according to an embodiment of the present disclosure has a hydrophobic surface that does not absorb moisture. This allows the surface of a fabric that becomes flame retardant to maintain functions such as water resistance for an extended period in a moist environment.

In this way, the eco-friendly flame retardant fabric according to the present disclosure may be considered to have a superior durability of the flame retardant treated surface, which is an outstanding effect compared to conventional art.

4. Measurement and Evaluation of Abrasion Resistance Test

Abrasion resistance test was performed by moving a mass back and forth on the surface of the eco-friendly flame retardant fabric according to an embodiment of the present disclosure.

Figure 5:
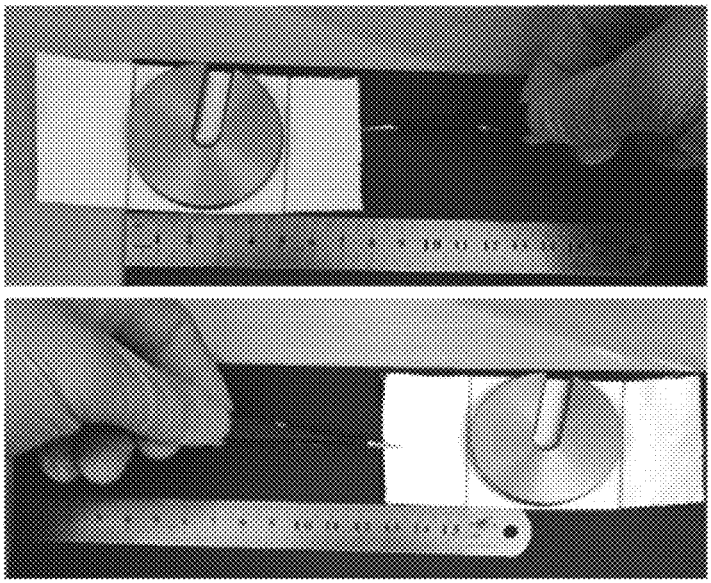
FIG. 5 illustrates a photograph and a graph showing the results of the abrasion resistance test of the eco-friendly flame retardant fabric prepared according to an embodiment of the present disclosure.
Figure 5:
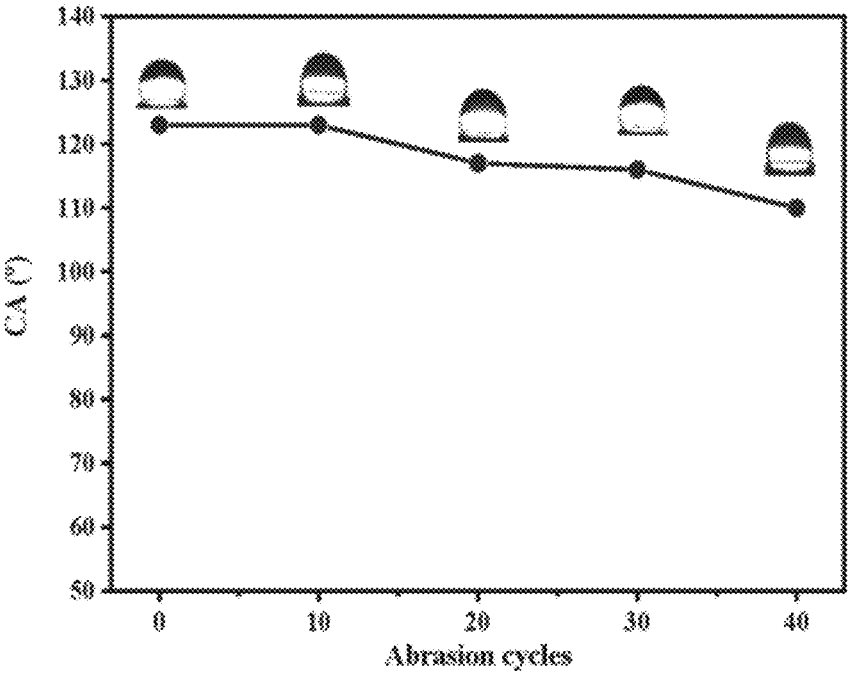

FIG. 5 illustrates a photograph and a graph showing the results of the abrasion resistance test of the eco-friendly flame retardant fabric prepared according to an embodiment of the present disclosure. Referring to FIG. 5, as a result of performing the abrasion resistance test by reciprocating and moving a mass on the surface of the eco-friendly flame retardant fabric according to Embodiment 1 of the present disclosure, it can be confirmed that the water repellency properties of the fiber is maintained when reciprocating 40 times. In addition, contact angle (CA) on the graph of (b) of FIG. 5 shows a contact angle between the fabric and water droplets, and the eco-friendly flame retardant fabric of Embodiment 1 of the present disclosure showed a tendency for the contact angle to gradually decrease as the number of abrasion increased. However, it was confirmed that the hydrophobicity was maintained.

5. Re-measurement and Evaluation of Flame Retardancy After Washing

The vertical burning test was performed according to the UL-94 standard test specification. After washing the eco-friendly flame retardant fabric according to an embodiment of the present disclosure, the vertical burning test was performed again.

Figure 6:
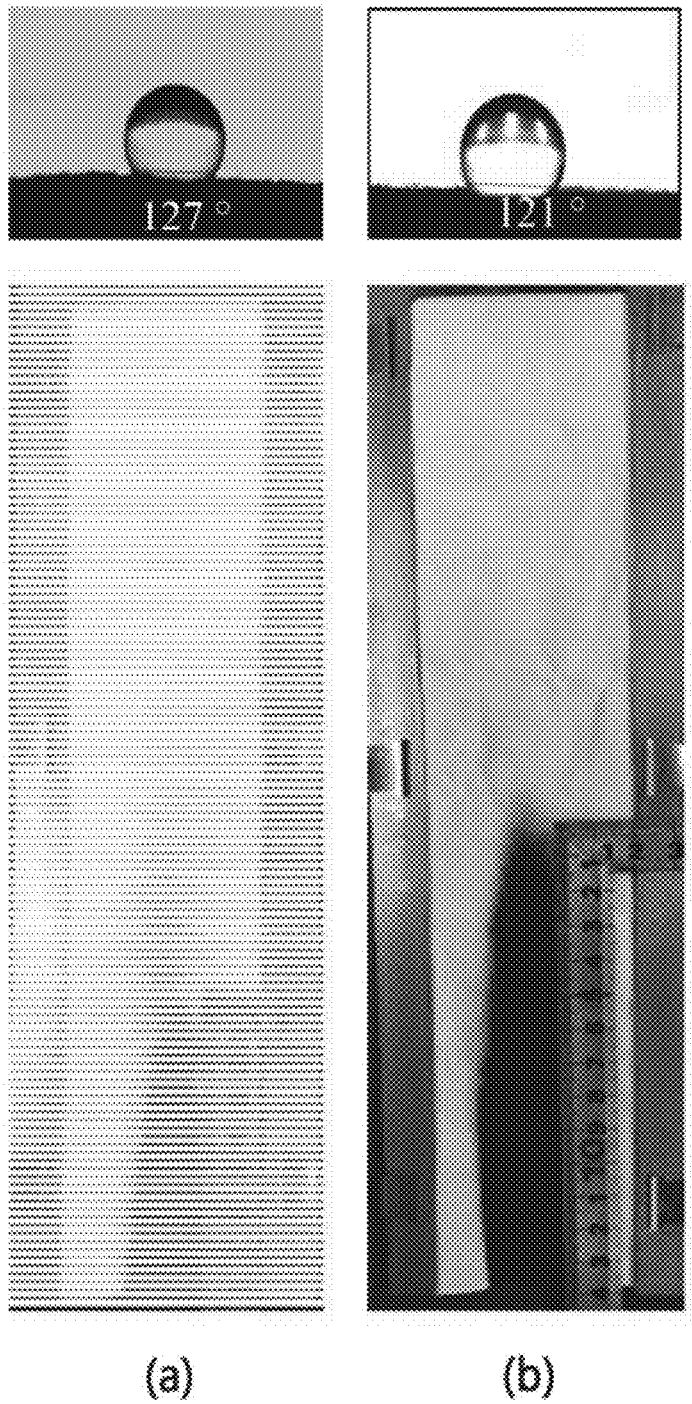
FIG. 6 illustrates a photograph showing the results of flame retardancy evaluation after washing of the eco-friendly flame retardant fabric prepared according to an embodiment of the present disclosure.

FIG. 6 illustrates a photograph showing the results of flame retardancy evaluation after washing of the eco-friendly flame retardant fabric prepared according to an embodiment of the present disclosure. Referring to FIG. 6, it can be confirmed that the eco-friendly flame retardant fabric according to Embodiment 1 of the present disclosure exhibits self-extinguishing behavior without flame propagation, although the length of soot caused by combustion is longer in the vertical burning test. Additionally, it can be confirmed that the water repellent properties and hydrophobicity are well maintained even after washing, as the contact angle changes very little.

6. Measurement and Evaluation of Surface Element

Surface element measurement was performed using Energy Dispersive Spectrometer (EDS) and Fourier Transform-InfraRed (FT-IR) spectroscopy methods.

Table 1 below shows the results of measuring the elements of an eco-friendly flame retardant fabric prepared according to an embodiment of the present disclosure through EDS.

TABLE 1

| Element | Untreated cotton | Comparative Example 1 | Comparative Example 2 | Embodiment 1 |
|---|---|---|---|---|
| | Element content (wt %) | | | |
| C | 54.78 | 56.42 | 51.00 | 53.05 |
| O | 45.22 | 43.58 | 47.00 | 43.63 |
| P | — | — | 1.70 | 2.72 |
| Si | — | — | 0.3 | 0.6 |

Referring to Table 1 above, it can be confirmed that the ecofriendly flame retardant fabric of Embodiment 1 of the present disclosure is sequentially surface treated with the first solution and the second solution, and that C, O, P, and Si are all observed on the surface of the fabric.

Figure 7:
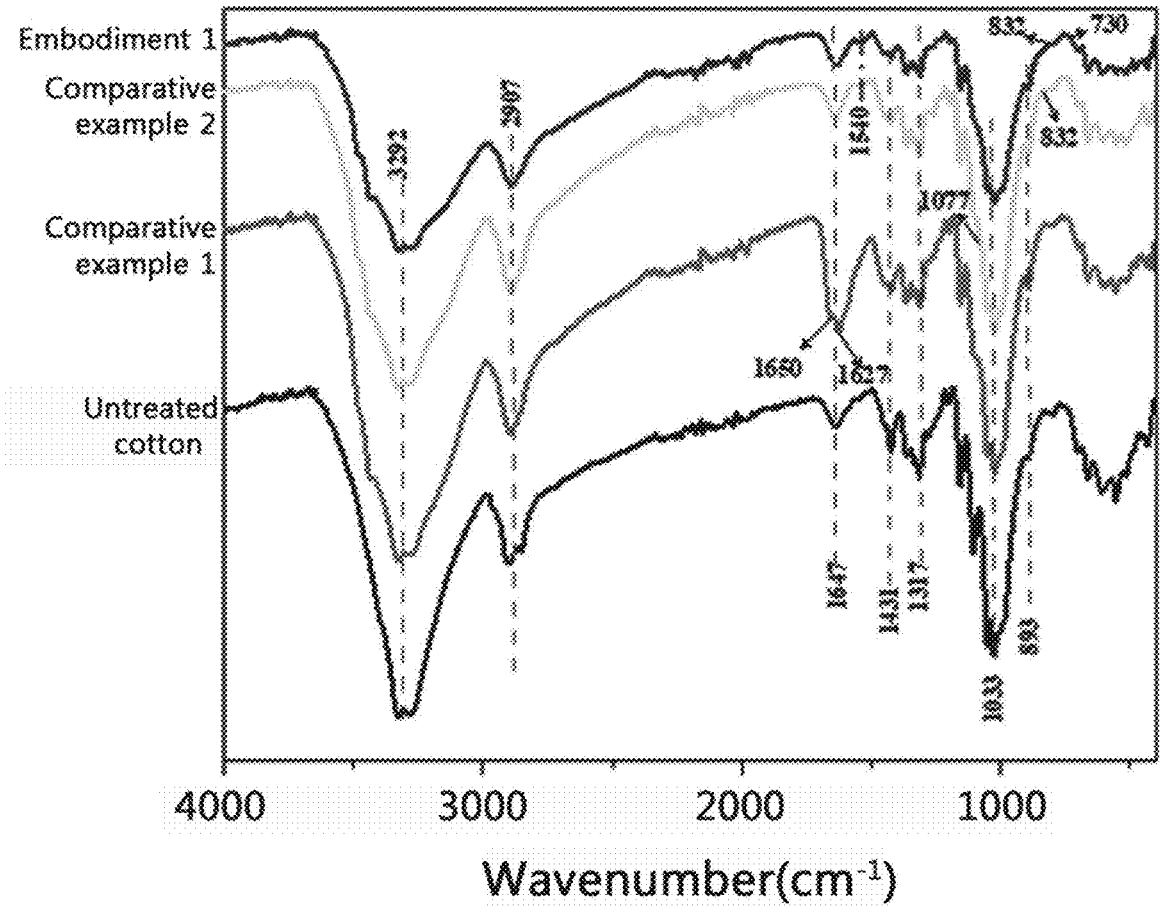
FIG. 7 illustrates a graph showing the results of FT-IR spectroscopy measurement of an eco-friendly flame retardant fabric prepared according to an embodiment of the present disclosure.

FIG. 7 illustrates a graph showing the results of FT-IR spectroscopy measurement of an eco-friendly flame retardant fabric prepared according to an embodiment of the present disclosure.

Referring to FIG. 7, it can be confirmed that the eco-friendly flame retardant fabric according to Embodiment 1 of the present disclosure has a new bond structure. Specifically, compared to untreated cotton, the fabric of Comparative Example 1 (treated only with the first solution), and the fabric of Comparative Example 2 (treated only with the second solution), the eco-friendly flame retardant fabric of Embodiment 1 of the present disclosure was sequentially surface treated with the first solution and the second solution and it can be confirmed that the elements of the solution used for surface treatment was chemically bonded to the cellulose of the cotton fiber.

According to the present disclosure, flame retardancy and durability can be improved by surface treatment of flammable natural fibers with eco-friendly flame retardants.

According to the present disclosure, the flame retardancy of natural fibers can be improved through a simplified process, and an eco-friendly flame retardant fabric with excellent flame retardancy and improved surface durability can be obtained.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation, Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of preparing an eco-friendly flame retardant fabric, comprising:

dipping a natural fiber into a first solution comprising chitosan, carboxylic acid, and urea at 20 to 60° C. for 10 to 100 minutes;

drying the natural fiber dipped into the first solution at 20 to 40° C. for 1 to 20 hours to form a first coating layer on the natural fiber; and dipping the dried natural fiber having the first coating layer into a second solution including alcohol, tetraalkyl orthosilicate (TAOS), and an additive at 20 to 60° C. for 10 to 100 minutes;

wherein the additive comprises at least one selected from a group consisting of phytic acid, ascorbic acid, kojic acid, inorganic acid, and lysophosphatidic acid.

2. The method of claim 1, wherein the natural fiber is a lignocellulosic fiber containing cellulose.

3. The method of claim 1, wherein the natural fiber comprises at least one selected from a group of cotton fibers, hemp fibers, flax fibers, sisal fibers, abaca fibers, jute fibers, and coir fibers.

4. The method of claim 1, wherein the carboxylic acid comprises at least one selected from a group of acetic acid, formic acid, propionic acid, oxalic acid, malonic acid, succinic acid, palmitic acid, stearic acid, oleic acid, benzoic acid, salicylic acid, and linolenic acid.

5. The method of claim 1, wherein the alcohol comprises at least one selected from a group of methanol, ethanol, n-propanol, isopropanol, glycerin, n-butanol, isobutanol, tert-butanol, n-pentanol, isopentanol, n-hexanol, isohexanol, n-heptanol, isoheptanol, n-octanol, isooctanol, n-nonanol, isononanol, n-decanol, isodecanol, 2-methoxyethanol, and 2-ethoxyethanol.

6. The method of claim 1, wherein the tetraalkyl orthosilicate comprises at least one selected from a group of tetraethyl orthosilicate (TEOS), tetramethyl orthosilicate (TMOS), tetrapropyl orthosilicate (TPOS), and tetrabutyl orthosilicate (TBOS).

7. The method of claim 1, further comprising:

drying the natural fiber dipped into the second solution.

8. The method of claim 7, wherein the drying of the natural fiber dipped into the second solution is performed at 20 to 40° C. for 1 to 20 hours.

9. The method of claim 1, wherein the flame retardant fabric exhibits water-repellent properties.

* * * * *